US009404502B2

(12) United States Patent
Ishikawa

(10) Patent No.: US 9,404,502 B2
(45) Date of Patent: Aug. 2, 2016

(54) CENTRIFUGAL FAN DEVICE

(71) Applicant: Nidec Corporation, Kyoto (JP)

(72) Inventor: Kazushi Ishikawa, Kyoto (JP)

(73) Assignee: NIDEC CORPORATION, Kyoto (JP)

( * ) Notice: Subject to any disclaimer, the term of this patent is extended or adjusted under 35 U.S.C. 154(b) by 919 days.

(21) Appl. No.: 13/676,155

(22) Filed: Nov. 14, 2012

(65) Prior Publication Data

US 2013/0156569 A1 Jun. 20, 2013

(30) Foreign Application Priority Data

Dec. 15, 2011 (JP) ..... 2011-274040

(51) Int. Cl.
*F04D 17/08* (2006.01)
*F04D 29/16* (2006.01)

(52) U.S. Cl.
CPC ..... *F04D 17/08* (2013.01); *F04D 29/162* (2013.01)

(58) Field of Classification Search
CPC ..... F01D 1/12; F04D 25/0613; F04D 25/282; F04D 25/4226; F04D 25/626; F04D 17/08; F04D 29/162
USPC ..... 312/62, 63; 417/354, 423.14, 420; 416/204 R, 220 R
See application file for complete search history.

(56) References Cited

U.S. PATENT DOCUMENTS 6,146,094 A 11/2000 Obana et al.
6,755,615 B2 * 6/2004 Chapman ..... F04D 29/023 415/206
7,163,371 B2 1/2007 Higashida
7,699,587 B2 * 4/2010 Chapman ..... F04D 25/082 310/89
7,883,312 B2 * 2/2011 Eguchi ..... F04D 29/162 415/119
2004/0219013 A1 * 11/2004 Hopfensperger ... F04D 29/4233 415/206
2006/0222491 A1 * 10/2006 Shimada ..... F04D 29/667 415/206
2007/0140834 A1 * 6/2007 Choi ..... F01D 3/04 415/104
2008/0069689 A1 * 3/2008 Sun ..... F02C 7/052 415/203
2013/0156569 A1 6/2013 Ishikawa

FOREIGN PATENT DOCUMENTS

JP 59-85499 A 5/1984
JP 62-6316 Y2 2/1987
JP 10-54388 A 2/1998
JP 2000-179491 A 6/2000
JP 2004-245087 A 9/2004
JP 2005-163751 A 6/2005
JP 2010-248941 A 11/2010

OTHER PUBLICATIONS

Hayamitsu et al.; "Centrifugal Fan"; U.S. Appl. No. 14/990,261, filed Jan. 7, 2016.
Hayamitsu; "Impeller and Blower"; U.S. Appl. No. 14/990,265, filed Jan. 7, 2016.

* cited by examiner

*Primary Examiner* — Nathaniel Wiehe
*Assistant Examiner* — Woody A Lee, Jr.
(74) *Attorney, Agent, or Firm* — Keating & Bennett

(57) ABSTRACT

A centrifugal fan device includes an impeller supported to rotate about a center axis extending in an up-down direction; a motor arranged to rotate the impeller; and a housing arranged to surround the impeller. The housing includes an intake portion positioned above the impeller and an exhaust portion positioned radially outward of the impeller. The impeller includes a base extending in a direction orthogonal to the center axis, a ring-shaped shroud positioned above the base and having a diameter which decreases as it goes upward, and a plurality of blades arranged between the base and the shroud. The housing further includes a plurality of ribs protruding from an inner surface of the intake portion toward the shroud.

16 Claims, 10 Drawing Sheets

CENTRIFUGAL FAN DEVICE

BACKGROUND OF THE INVENTION

1. Field of the Invention

The present invention relates to a centrifugal fan device.

2. Description of the Related Art

Conventionally, there is known a centrifugal fan device for rotating an impeller with the drive power of a motor and discharging an axially drawn gas in a circumferential direction. The centrifugal fan device is used as, e.g., a suction means for a cleaner or an air cooling means for an electronic device.

A structure of a conventional centrifugal fan device is disclosed in, e.g., U.S. Patent Application Publication No. 2008/0069689 A1 (hereinafter US 2008/0069689). The centrifugal fan device of US 2008/0069689 includes a housing, an impeller arranged within the housing, and a drive device for rotating the impeller (see, for example, Claim 1 and FIGS. 1A and 3B of US 2008/0069689). In the centrifugal fan device of US 2008/0069689, a drawing hole is formed in a top shell of the housing (see, for example, Claim 5 and FIGS. 1A and 3B of US 2008/0069689).

In the centrifugal fan device disclosed in US 2008/0069689, a groove is formed on the lower surface of the top shell around the drawing hole. The upper end portion of a top panel of the impeller is inserted into the groove (see, for example, FIG. 3B of US 2008/0069689). However, with the structure of US 2008/0069689, the vibrations and noises of the top shell grow larger around the drawing hole. In particular, the problem of vibrations and noises becomes severe when driving the centrifugal fan device at a high speed.

SUMMARY OF THE INVENTION

Preferred embodiments of the present invention provide a centrifugal fan device capable of reducing vibrations and noises during an operation.

In accordance with a preferred embodiment of the present invention, a centrifugal fan device includes: an impeller supported to rotate about a center axis extending in an up-down direction; a motor arranged to rotate the impeller; and a housing arranged to surround the impeller. The housing includes an intake portion positioned above the impeller and an exhaust portion positioned radially outward of the impeller. The impeller includes a base extending in a direction orthogonal to the center axis, a ring-shaped shroud positioned above the base and having a diameter which decreases as it goes upward, and a plurality of blades arranged between the base and the shroud. The intake portion includes a cylinder portion positioned radially inward of an upper end portion of the shroud to extend in an axial direction, a top plate portion extending radially outward from an upper end portion of the cylinder portion, and an outer shell portion extending downward and radially outward from a radial outer edge of the top plate portion, and the housing further includes a plurality of ribs protruding from an inner surface of the intake portion toward the shroud.

With the illustrative first preferred embodiment of the present invention, the cylinder portion of the housing is preferably arranged radially inward of the upper end portion of the shroud. Therefore, a gas can be efficiently drawn into a space between the base and the shroud in the intake portion. The rigidity of the intake portion of the housing is increased by the ribs. Accordingly, it is possible to reduce vibrations and noises during an operation.

The above and other elements, features, steps, characteristics and advantages of the present invention will become more apparent from the following detailed description of the preferred embodiments with reference to the attached drawings.

DETAILED DESCRIPTION OF THE PREFERRED EMBODIMENTS

Preferred embodiments of the present invention will now be described with reference to the drawings which form a part hereof. In the subject application, the direction extending along the center axis of a motor will be referred to as "axial direction". The direction orthogonal to the center axis of a motor will be referred to as "radial direction". The direction extending along a circular arc about the center axis of a motor will be referred to as "circumferential direction". In the subject application, the shape and positional relationship of individual components will be described under the assumption that the axial direction is an up-down direction and the side of an intake portion with respect to an impeller is an "upper side". However, these definitions are made merely for the sake of convenience in description and are not intended to limit the direction when the present centrifugal fan device is used.

First Preferred Embodiment

Figure 1:
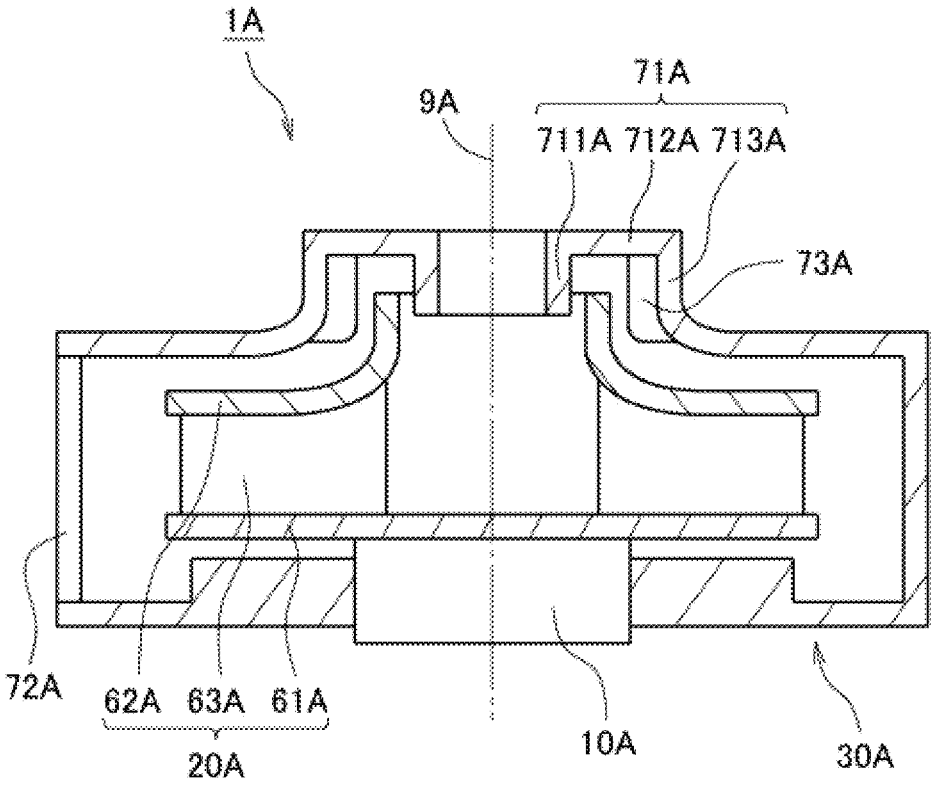
FIG. 1 is a vertical sectional view showing a centrifugal fan device according to a first preferred embodiment of the present invention.

FIG. 1 is a vertical section view showing a centrifugal fan device 1A in accordance with a first preferred embodiment of the present invention. Referring to FIG. 1, the centrifugal fan device 1A preferably includes a motor 10A, an impeller 20A, and a housing 30A. The impeller 20A is supported to rotate about a center axis 9A. The impeller 20A is rotated by the motor 10A.

As shown in FIG. 1, the impeller 20A preferably includes a base 61A, a shroud 62A, and a plurality of blades 63A. The base 61A extends in the direction orthogonal to the center axis 9A. The shroud 62A is positioned above the base 61A. The shroud 62A preferably has an annular shape and the diameter of the shroud 62A decreases as it goes upward. In other words, the shroud 62A is inclined in such a direction that the angle of the shroud 62A with respect to the center axis 9A grows smaller as the shroud 62A extends radially inward. In this example, the innermost edge of the shroud 62A is parallel or substantially parallel to the center axis 9A. The blades 63A are preferably arranged between the base 61A and the shroud 62A.

The housing 30A surrounds the impeller 20A. The housing 30A preferably includes an intake portion 71A and an exhaust portion 72A. The intake portion 71A is positioned above the impeller 20A. The exhaust portion 72A is positioned radially outward of the impeller 20A.

As shown in FIG. 1, the intake portion 71A preferably includes a cylinder portion 711A, a top plate portion 712A, and an outer shell portion 713A. The cylinder portion 711A is positioned radially inward of the upper end portion of the shroud 62A and extends in the axial direction. The top plate portion 712A extends radially outward from the upper end portion of the cylinder portion 711A. The outer shell portion 713A extends downward and radially outward from the radial outer edge of the top plate portion 712A.

In the centrifugal fan device 1A, as set forth above, the cylinder portion 711A of the housing 30A is preferably arranged radially inward of the upper end portion of the shroud 62A. For that reason, a gas can be efficiently drawn from the intake portion 71A into a space between the base 61A and the shroud 62A.

The housing 30A preferably further includes ribs 73A protruding from the inner surface of the intake portion 71A toward the shroud 62A. The rigidity of the intake portion 71A of the housing 30A is preferably increased by the ribs 73A. This reduces vibrations and noises generated during the operation of the centrifugal fan device 1A.

Second Preferred Embodiment

Figure 2:
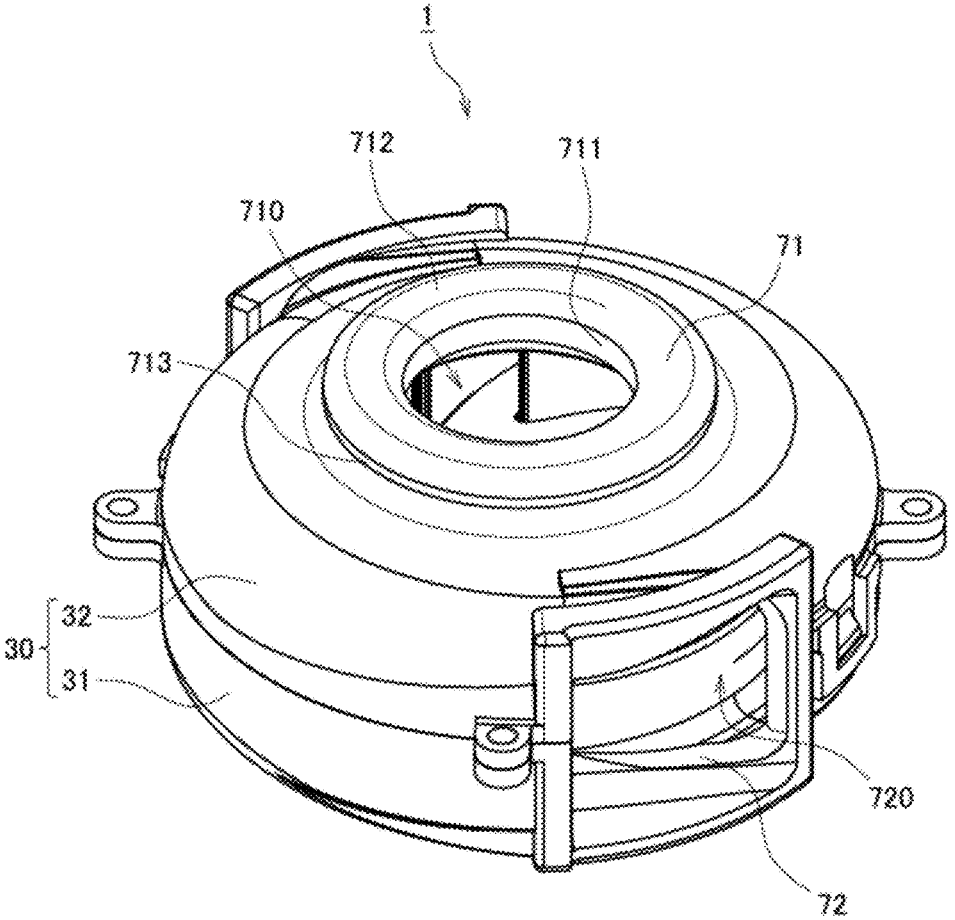
FIG. 2 is a perspective view showing a centrifugal fan device according to a second preferred embodiment of the present invention.
Figure 3:
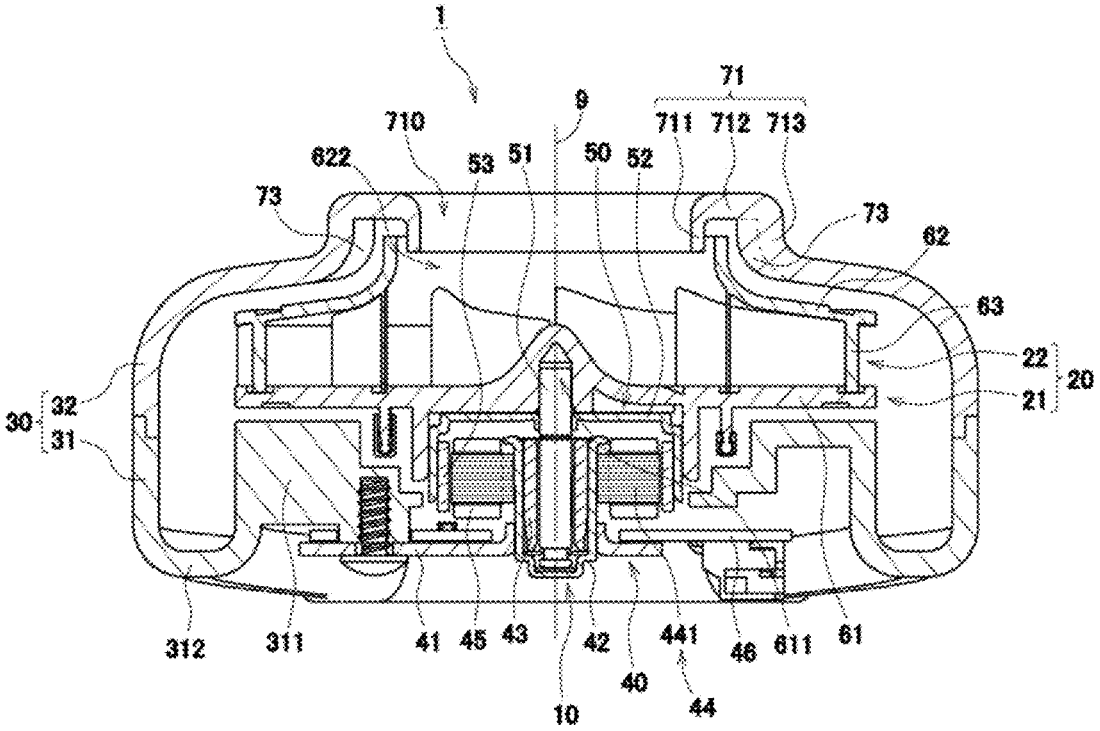
FIG. 3 is a vertical sectional view of the centrifugal fan device according to the second preferred embodiment of the present invention.

Next, description will be made of a second preferred embodiment of the present invention. FIG. 2 is a perspective view showing a centrifugal fan device 1 in accordance with the second preferred embodiment. FIG. 3 is a vertical section view of the centrifugal fan device 1. The centrifugal fan device 1 is preferably mounted to a suction-type cleaning device such as, for example, a self-propelled cleaning robot, a hand-held cleaner, a vacuum cleaner, etc., and is used as suction device of the cleaning device. As shown in FIGS. 2 and 3, the centrifugal fan device 1 of the present preferred embodiment preferably includes a motor 10, an impeller 20, and a housing 30.

The motor 10 preferably includes a stationary unit 40 and a rotary unit 50. The stationary unit 40 is kept stationary with respect to the housing 30. The rotary unit 50 is supported to rotate with respect to the stationary unit 40. The stationary unit 40 preferably includes an attachment plate 41, a bearing holder 42, a sleeve 43, a stator core 44, a coil 45, and a circuit board 46. The rotary unit 50 preferably includes a shaft 51, a rotor holder 52, and a plurality of magnets 53.

The attachment plate 41 is preferably a substantially flat member extending in the direction orthogonal to the center axis 9. The attachment plate 41 is fixed to a lower housing member 31. The bearing holder 42 is a cup-shaped member fixed to the attachment plate 41. The sleeve 43 is held within the bearing holder 42. The sleeve 43 preferably has a substantially cylindrical inner circumferential surface corresponding to an outer circumferential surface of the shaft 51.

The stator core 44 is preferably fixed to the outer circumferential surface of the bearing holder 42. The stator core 44 preferably includes a plurality of radially extending teeth 441. The coil 45 is preferably defined by conductive wires wound around the respective teeth 441, but any other desirable type of coil 45 could be used. The circuit board 46 is fixed to the upper surface of the attachment plate 41. An electronic circuit arranged to apply a drive current to the coil 45 is preferably mounted to the circuit board 46.

The shaft 51 is preferably a columnar member extending in the axial direction. The shaft 51 is supported by the sleeve 43 and the bearing holder 42 to rotate about the center axis 9. The upper end portion of the shaft 51 preferably protrudes upward beyond the upper surface of the sleeve 43. The rotor holder 52 is fixed to the shaft 51 and is rotated together with the shaft 51. The magnets 53 are positioned radially outward of the stator core 44 and are fixed to the rotor holder 52. The magnets 53 are arranged along the circumferential direction such that N-poles and S-poles alternately stand side by side.

If a drive current is applied to the coil 45 through the circuit board 46, magnetic fluxes are generated in the teeth 441 of the stator core 44. Circumferential torque is generated by the action of the magnetic fluxes between the teeth 441 and the magnets 53. As a result, the rotary unit 50 is rotated about the center axis 9 with respect to the stationary unit 40.

The impeller 20 is supported to rotate together with the rotary unit 50 of the motor 10. In the present preferred embodiment, the impeller 20 preferably includes a lower impeller member 21 and an upper impeller member 22 arranged above the lower impeller member 21. As shown in FIG. 3, the lower impeller member 21 preferably includes a substantially disc-shaped base 61 extending in the direction orthogonal to the center axis 9. The upper end portion of the shaft 51 is preferably, for example, press-fitted to an attachment hole 611 defined on the lower surface of the base 61. Consequently, the shaft 51 and the base 61 are fixed together.

The upper impeller member 22 preferably includes a shroud 62 and a plurality of blades 63. The shroud 62 is preferably positioned above the base 61 and extends to have an annular shape. The shroud 62 is inclined such that the shroud 62 goes upward as it comes close to the center axis 9. Therefore, the diameter of the shroud 62 decreases as it goes upward. In other words, the shroud 62 is preferably inclined in such a direction that the angle of the shroud 62 with respect to the center axis 9 decreases as the shroud 62 extends radially inward. A circular opening 622 arranged to draw a gas therethrough is preferably defined inside the upper end portion of the shroud 62.

The blades 63 extend downward from the lower surface of the shroud 62. Therefore, the blades 63 are preferably arranged between the base 61 and the shroud 62. Each of the blades 63 obliquely extends with respect to the radial direction and the circumferential direction. The lower end portions of the blades 63 are welded to the upper surface of the base 61. Consequently, the lower impeller member 21 and the upper impeller member 22 are preferably fixed together. Details of the fixing structure of the lower impeller member 21 and the upper impeller member 22 will be described later.

The housing 30 preferably includes a lower housing member 31 and an upper housing member 32 arranged above the lower housing member 31. The lower housing member 31 preferably includes a bottom plate portion 311 positioned below the impeller 20 and a groove portion 312 positioned radially outward of the bottom plate portion 311. The bottom plate portion 311 extends radially outward from a position near the outer peripheral portion of the motor 10. The groove portion 312 is preferably positioned radially outward of the impeller 20 and extends in the circumferential direction so as to surround the bottom plate portion 311. As shown in FIG. 3, the groove portion 312 has a substantially U-shaped upper surface when seen in a cross-sectional view.

The upper housing member 32 is preferably a ring-shaped member arranged to cover the upper surface and side portion of the impeller 20. The lower end of the outer peripheral portion of the upper housing member 32 is preferably fixed to the upper end of the outer peripheral portion of the lower housing member 31. The impeller 20 is preferably surrounded by the lower housing member 31 and the upper housing member 32. The housing 30 preferably includes an intake portion 71 positioned above the impeller 20 and an exhaust portion 72 positioned radially outward of the impeller 20. An intake port 710 arranged to draw a gas from the outside therethrough is preferably defined in the intake portion 71. An exhaust port 720 arranged to discharge a gas toward the outside therethrough is preferably provided in the exhaust portion 72.

When the motor 10 is driven, the impeller 20 is rotated together with the rotary unit 50 of the motor 10. Then, a gas is admitted into the housing 30 through the intake port 710. The gas admitted into the housing 30 is accelerated by the impeller 20. As a result, the gas flows in the circumferential direction along the upper surface of the groove portion 312 of the lower housing member 31. Thereafter, the gas is discharged to the outside of the housing 30 through the exhaust port 720.

Figure 4:
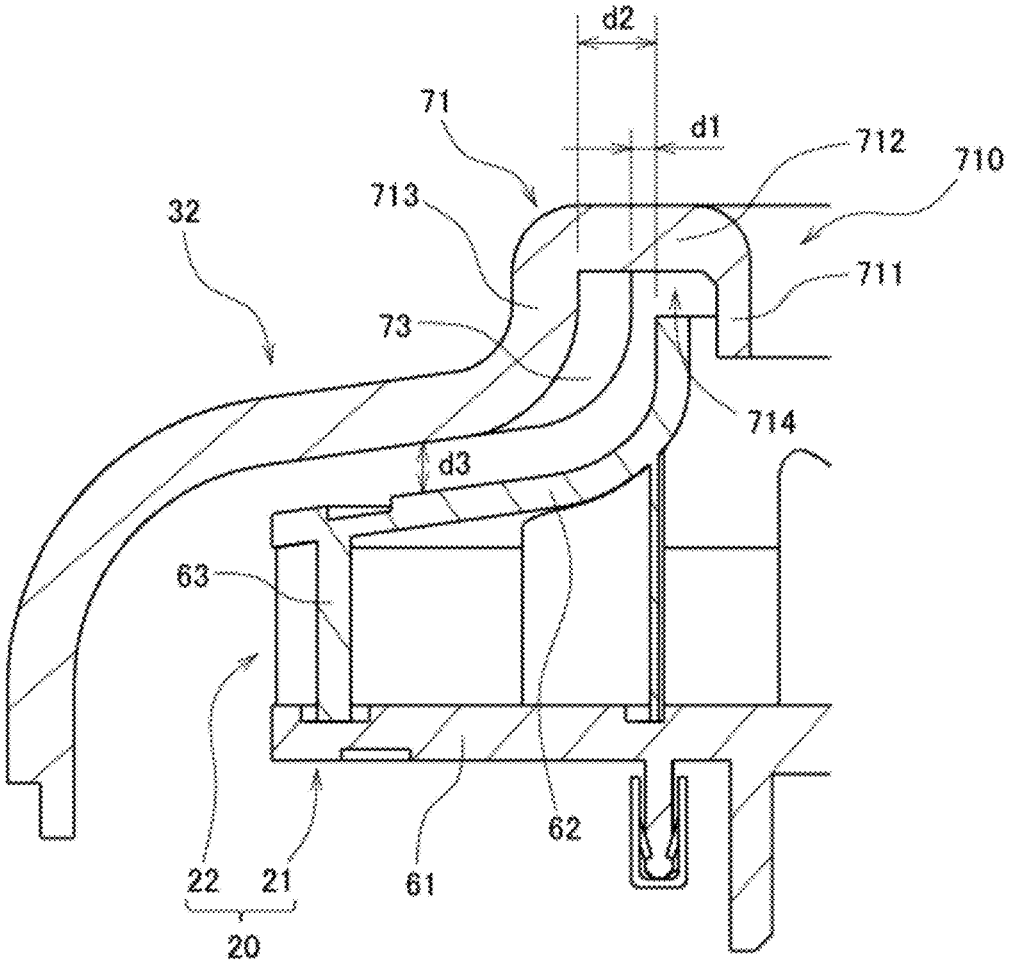
FIG. 4 is a partial vertical sectional view showing an upper housing member and an impeller according to the second preferred embodiment of the present invention.
Figure 5:
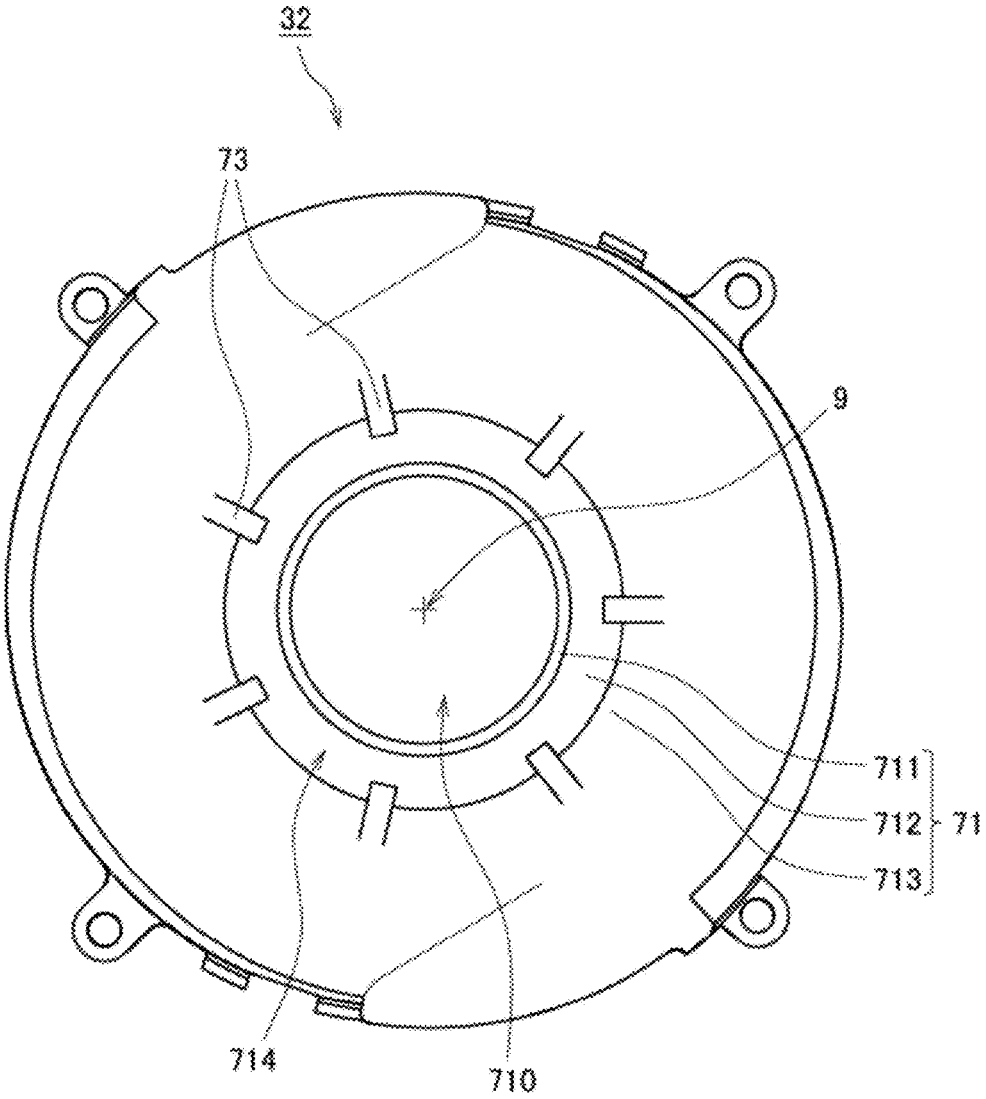
FIG. 5 is a bottom view of the upper housing member according to the second preferred embodiment of the present invention.

Subsequently, the detailed structure of the upper housing member 32 will be discussed. FIG. 4 is a partial vertical section view of the upper housing member 32 and the impeller 20. FIG. 5 is a bottom view of the upper housing member 32.

As set forth above, the upper housing member 32 is provided with the intake portion 71. The intake portion 71 preferably includes a cylinder portion 711, a top plate portion 712, and an outer shell portion 713. The cylinder portion 711 is preferably arranged around the intake port 710 and extends in the axial direction to have a cylindrical shape. The top plate portion 712 extends radially outward from the upper end portion of the cylinder portion 711. The outer shell portion 713 extends downward and radially outward from the radial outer edge of the top plate portion 712. The upper housing member 32 preferably includes an annular groove 714 provided on the lower surface of the intake portion 71. The upper end portion of the shroud 62 is arranged within the groove 714.

The cylinder portion 711 is positioned radially inward of the upper end portion of the shroud 62. This prevents a gas from flowing from the intake port 710 to a space between the shroud 62 and the upper housing member 32. The gas drawn from the outside is efficiently admitted into a space between the base 61 and the shroud 62 through the intake port 710. In particular, in the present preferred embodiment, the lower end portion of the cylinder portion 711 is positioned lower than the upper end portion of the shroud 62. For that reason, a gas is efficiently admitted from the intake port 710 into the space between the base and the shroud 62. As a result, it becomes possible to increase the static pressure of the centrifugal fan device 1.

As shown in FIGS. 4 and 5, the upper housing member 32 preferably further includes a plurality of flat ribs 73. Each of the flat ribs 73 protrudes from the inner surface of the intake portion 71 toward the shroud 62. In the present preferred embodiment, the rigidity of the intake portion 71 is preferably increased by the flat ribs 73. As a result, it is possible to reduce vibrations and noises of the upper housing member 32 during the operation of the centrifugal fan device 1.

In a hypothetical case where flat ribs are provided on the outer surface of an intake portion, structural constraints on, for example, a cleaning device, grow larger when a centrifugal fan device is installed in the cleaning device. Accordingly, in the present preferred embodiment, the flat ribs 73 are preferably provided on the inner surface of the intake portion 71. Also, on the outer surface of the intake portion 71 there are preferably no irregularities which may otherwise be generated by ribs. Accordingly, it is possible to reduce constraints on the installation of the centrifugal fan device 1.

In particular, in the present preferred embodiment, the upper surface of the top plate portion 712 is preferably a smooth surface substantially orthogonal to the center axis 9. This makes it easy to bring the upper surface of the top plate portion 712 into close contact with a member of, e.g., a cleaning device. If the upper surface of the top plate portion 712 is brought into close contact with the member of the cleaning device, it becomes possible to prevent leakage of a gas from the vicinity of the top plate portion 712. As a result, it is possible to increase the static pressure of the centrifugal fan device 1 when mounted to the cleaning device.

The flat ribs 73 preferably extend radially and axially from the inner surface of the intake portion 71. For that reason, it is possible to reduce the radial and axial vibration components of the intake portion 71. The flat ribs 73 included in the present preferred embodiment are preferably connected to both the lower surface of the top plate portion 712 and the radial inner surface of the outer shell portion 713. Since the flat ribs 73 extend along two surfaces in this manner, it is possible to increase the rigidity of the intake portion 71 and to reduce vibrations thereof.

In the present preferred embodiment, the radial inner end portions of the flat ribs 73 are preferably arranged radially outward of the upper end portion of the shroud 62. This makes it possible to have the upper end portion of the shroud 62 and the lower surface of the top plate portion 712 be close to each other while preventing the flat ribs 73 from making contact with the upper end portion of the shroud 62. As a result, it is possible to reduce the total axial dimension of the centrifugal fan device 1.

In the present preferred embodiment, the radial dimension of the flat ribs 73 is decreased as it extends radially outward. When seen in a vertical cross section including the center axis 9 and the flat ribs 73, the lower edges of the flat ribs 73 and the lower surface of the outer shell portion 713 are smoothly joined to each other. When seen in the vertical cross section, the lower surfaces of the flat ribs 73 and the outer shell portion 713 are inclined to gradually descend radially outward. The lower surface of the section of the outer shell portion 713 lying radially outward of the flat ribs 73 is preferably positioned lower than the lower end portions of the flat ribs 73.

For that reason, it is easy to have the flat ribs 73 and the upper surface of the shroud 62 be close to each other while preventing the flat ribs 73 from making contact with the shroud 62. If the flat ribs 73 and the upper surface of the shroud 62 are close to each other, it is possible to prevent a gas from flowing from the intake portion 71 to the space between the shroud 62 and the upper housing member 32.

In this regard, as shown in FIG. 4, it is assumed that the radial distance between the radial inner edge of each of the flat ribs 73 and the outer circumferential surface of the upper end portion of the shroud 62 is d1. It is also assumed that the radial distance between the radial inner edge of the outer shell portion 713 and the outer circumferential surface of the upper end portion of the shroud 62 is d2. It is further assumed that the axial distance between the lower surface of the section of the outer shell portion 713 lying radially outward of the flat ribs 73 and the upper surface of the shroud 62 is d3.

In order to prevent a gas from flowing into the space between the shroud 62 and the upper housing member 32, it is desirable to shorten the distance between the flat ribs 73 and the upper end portion of the shroud 62. Therefore, d3 is preferably set larger than d1. In order to increase the rigidity of the intake portion 71, it is desirable to increase the radial dimension of the flat ribs 73. Therefore, d2 is preferably set to be larger than d3, which in turn is set to be larger than d1.

In the present preferred embodiment, as shown in FIG. 5, preferably seven, for example, flat ribs 73 are provided in the upper housing member 32. The seven flat ribs 73 are preferably arranged substantially at an equal interval in the circumferential direction. The number of the flat ribs 73 of the upper housing member 32 may alternatively be any number other than seven if so desired. It is however preferred that the number of the flat ribs 73 do not match up with any one of the number of the blades 63 of the impeller 20, the pole number of the motor 10, and the slot number of the motor 10. This makes it possible to restrain the flat ribs 73 from resonating with other members. The pole number is preferably equal to the magnetic pole number of the magnets of the motor 10. The slot number is preferably equal to the number of the teeth 441 of the motor 10.

In the present preferred embodiment, the upper housing member 32 is preferably, for example, a resin molded article that can be obtained by injection molding, however, any other desirable material and forming method could be used. Use of the injection molding makes it possible to easily mold the flat ribs 73. In a hypothetical case that an attempt is made to obtain high rigidity by increasing the overall thickness of an intake portion instead of forming flat ribs, a partial depression is easily generated on the surface of the intake portion when cooling and solidifying a molten resin. In the present preferred embodiment, however, the rigidity of the intake portion 71 is preferably increased by the flat ribs 73 while reducing the thickness of the intake portion 71. This prevents generation of a partial depression. It is also possible to reduce the use amount of a resin as compared with a case where the thickness of the intake portion is increased as a whole.

Figure 6:
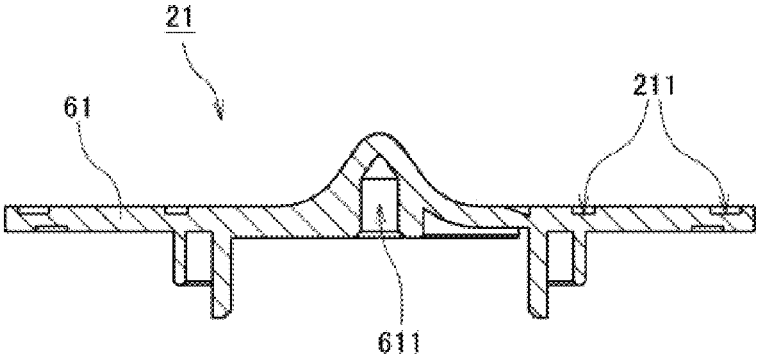
FIG. 6 is a vertical sectional view showing a lower impeller member according to the second preferred embodiment of the present invention.
Figure 7:
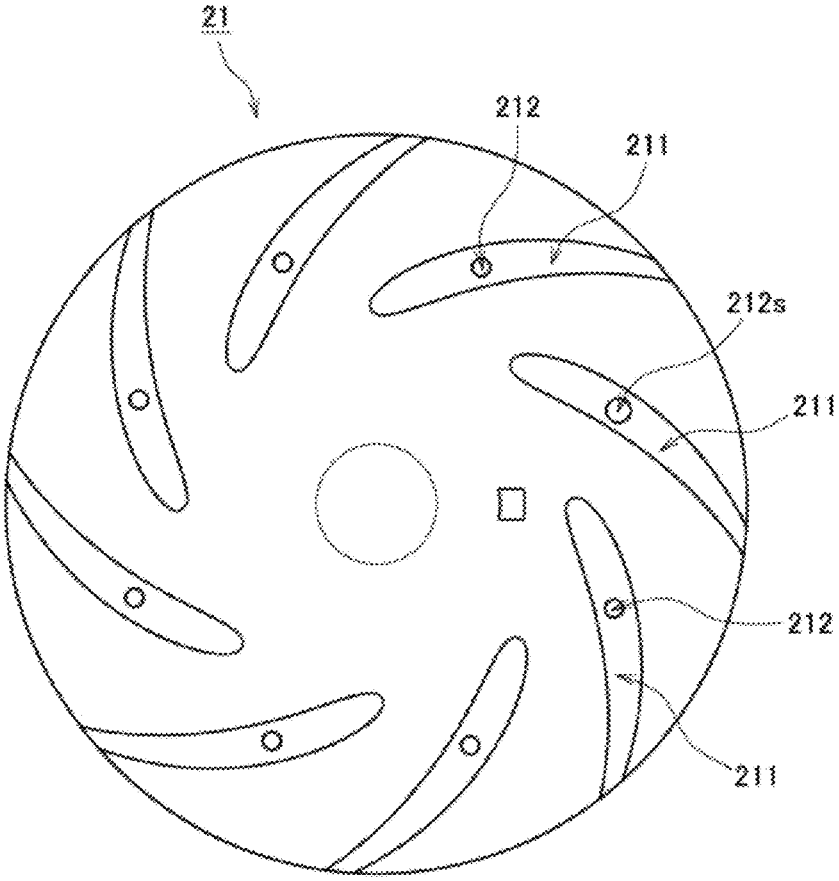
FIG. 7 is a plan view of the lower impeller member according to the second preferred embodiment of the present invention.
Figure 8:
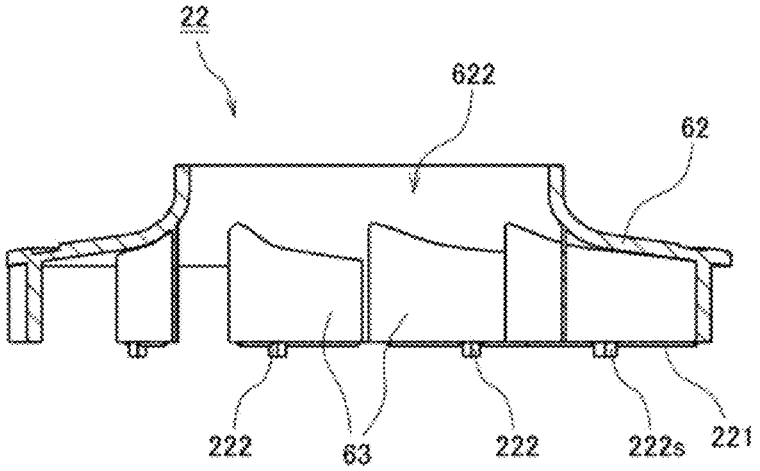
FIG. 8 is a vertical sectional view showing an upper impeller member according to the second preferred embodiment of the present invention.
Figure 9:
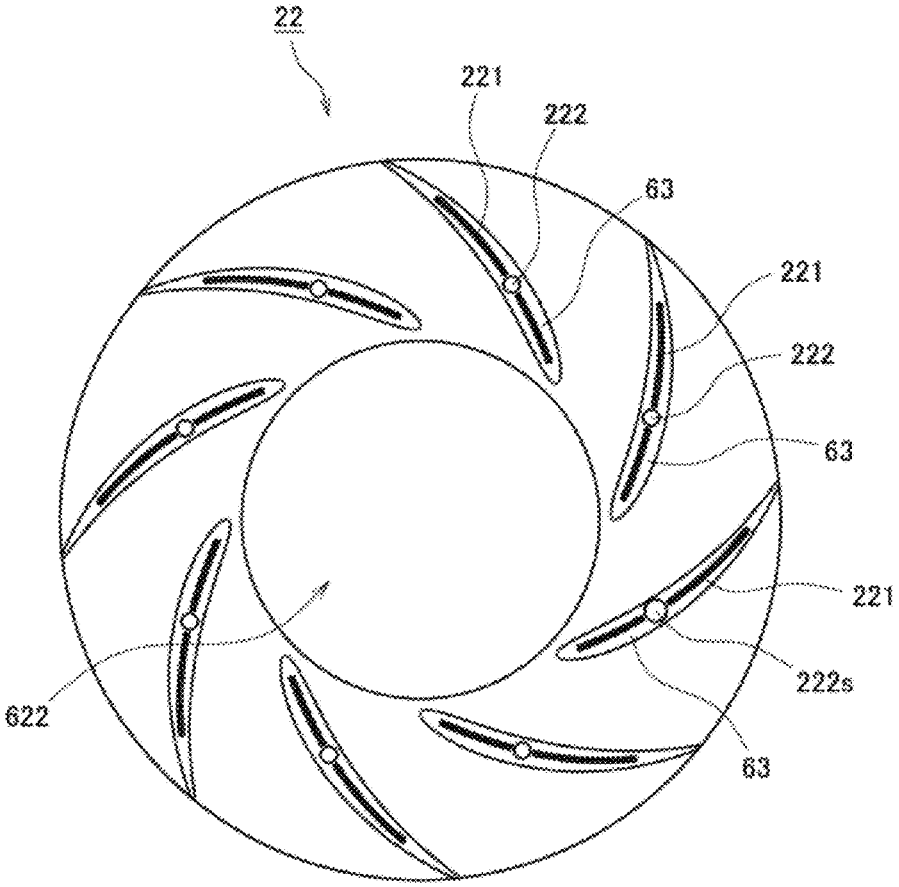
FIG. 9 is a bottom view of the upper impeller member according to the second preferred embodiment of the present invention.

Next, description will be made on a fixing structure of the lower impeller member 21 and the upper impeller member 22. FIG. 6 is a vertical section view of the lower impeller member 21. FIG. 7 is a plan view of the lower impeller member 21. FIG. 8 is a vertical section view of the upper impeller member 22. FIG. 9 is a bottom view of the upper impeller member 22.

As shown in FIGS. 6 and 7, a plurality of first recesses 211 is preferably provided on the upper surface of the base 61 of the lower impeller member 21. Each of the first recesses 211 obliquely extends with respect to the radial direction and the circumferential direction. The first recesses 211 are arranged substantially at an equal interval along the circumferential direction in a corresponding relationship with the blades 63. Second recesses 212 depressed further downward from the first recesses 211 are defined in the base 61. The second recesses 212 are substantially circular depressions smaller in size than the first recesses 211 when seen in a top view.

On the other hand, as shown in FIGS. 8 and 9, first protrusions 221 and second protrusions 222 are preferably provided on the lower surfaces of the blades 63 of the upper impeller member 22. The first protrusions 221 extend along the blades 63. In other words, the first protrusions 221 obliquely extend with respect to the radial direction and the circumferential direction. The lower end portions of the first protrusions 221 are preferably thinned in a downward direction. The second protrusions 222 are preferably substantially cylindrical columnar lugs smaller in size than the blades 63 when seen in a bottom view. The second protrusions 222 are arranged in a corresponding relationship with the second recesses 212.

When manufacturing the impeller 20, the lower end portions of the blades 63 are preferably fitted to the first recesses 211 of the base 61. The second protrusions 222 of the blades 63 are preferably fitted to the second recesses 212 of the base 61. At this time, the lower end portions of the first protrusions 221 of the blades 63 make contact with the bottom portions of the first recesses 211 of the base 61.

Thereafter, ultrasonic vibrations, for example, are applied to at least one of the lower impeller member 21 and the upper impeller member 22. Then, because of the ultrasonic vibrations, frictional heat is generated between the upper surface of the base 61 and the first protrusions 221 of the blades 63. Thus, the first protrusions 221 are melted by the frictional heat. As a result, the lower impeller member 21 and the upper impeller member 22 are welded together.

From the standpoint of manufacture, it is difficult to bring the gravity center positions of the lower impeller member 21 and the upper impeller member 22 into perfect alignment with the center axis 9. In a hypothetical case where the gravity center deviation of the lower impeller member 21 and the gravity center deviation of the upper impeller member 22 overlap in the same direction, the gravity center deviation of the impeller 20 as a whole becomes larger. For that reason, when manufacturing the impeller 20, the relative rotation positions of the lower and upper impeller members 21 and 22 with respect to the center axis 9 is preferably set such that the gravity center deviation of the lower impeller member 21 and the gravity center deviation of the upper impeller member 22 are cancelled each other.

In the present preferred embodiment, the diameter of the second recess 212*s*, one of the second recesses 212, is preferably set larger than the diameter of the remaining second recesses 212. Likewise, the diameter of the second protrusion 222*s*, one of the second protrusions 222, is preferably set larger than the diameter of the remaining second protrusions 222. In the following description, the second recess 212*s* having a large diameter will be referred to as large-diameter second recess 212*s*. Moreover, the second protrusion 222*s* having a large diameter will be referred to as large-diameter second protrusion 222*s*.

When manufacturing the impeller 20, the large-diameter second protrusion 222*s* is fitted to the large-diameter second recess 212*s*. It is not possible to fit the large-diameter second protrusion 222*s* to the second recesses 212 other than the large-diameter second recess 212*s*. Accordingly, the relative rotation positions of the lower impeller member 21 and the upper impeller member 22 are uniquely specified.

In the present preferred embodiment, the impeller 20 is a resin molded article that can be obtained by injection molding. When manufacturing the impeller 20, the tendency of the gravity center deviations of the lower impeller member 21 and the upper impeller member 22 is inspected in advance. Then, the positions of the large-diameter second recess 212*s* and the large-diameter second protrusion 222*s* are set such that, when the lower and upper impeller members 21 and 22 are combined together, the gravity center deviations of the lower and upper impeller members 21 and 22 are in the substantially opposite directions.

This makes it possible to reduce the gravity center deviation of the impeller 20 as a whole even when each of the lower and upper impeller members 21 and 22 has a gravity center deviation. It is also preferably possible to simplify or omit a step of correcting the gravity center of the impeller 20 after the lower impeller member 21 and the upper impeller member 22 are combined together. As a result, it becomes possible to shorten the manufacturing process of the impeller 20.

MODIFIED EXAMPLES OF PREFERRED EMBODIMENTS

While one illustrative preferred embodiment of the present invention has been described above, the present invention is not limited thereto.

Figure 10:
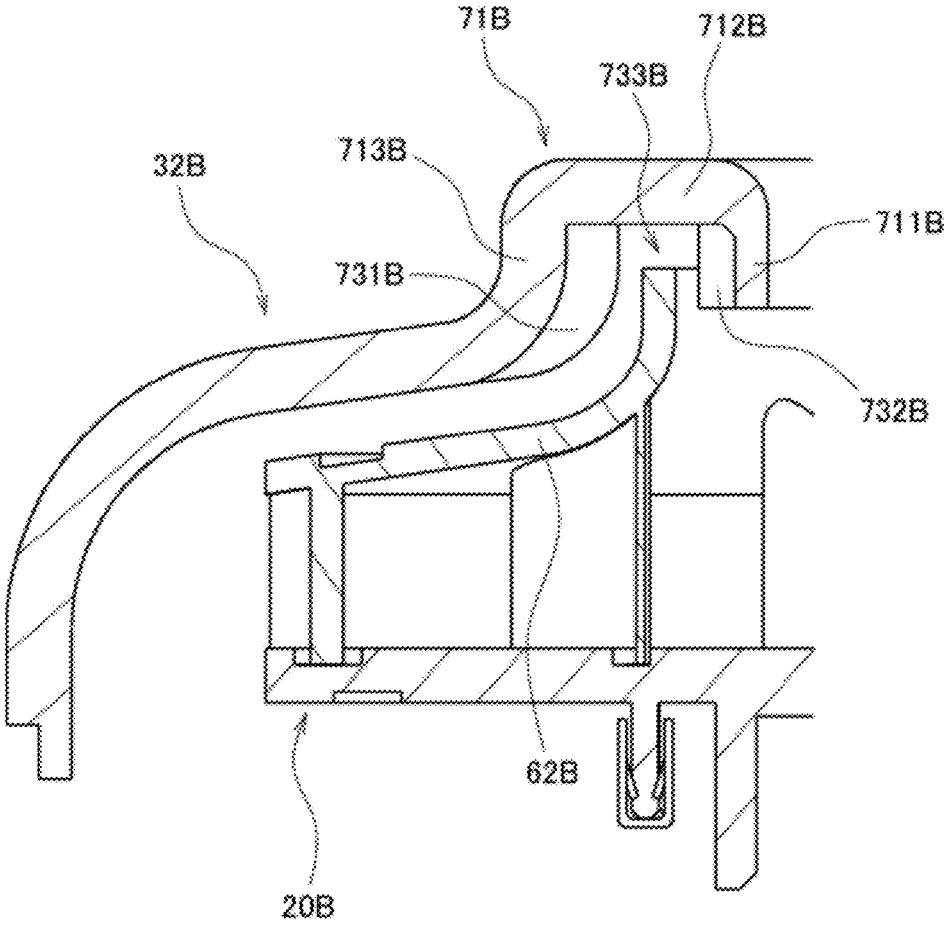
FIG. 10 is a partial vertical sectional view showing an upper housing member and an impeller according to one modified example of a preferred embodiment of the present invention.

FIG. 10 is a partial vertical section view showing an upper housing member 32B and an impeller 20B in accordance with one modified example of a preferred embodiment of the present invention. In the example shown in FIG. 10, a plurality of first flat ribs 731B and a plurality of second flat ribs 732B are provided on the inner surface of an intake portion 71B. The first flat ribs 731B are positioned radially outward of the upper end portion of a shroud 62B. The second flat ribs 732B are positioned radially inward of the upper end portion of the shroud 62B. By installing the flat ribs in different radial positions in this manner, it is preferably possible to further increase the rigidity of the intake portion 71B.

In the example shown in FIG. 10, a cutout 733B is arranged between the first flat ribs 731B and the second flat ribs 732B. The upper end portion of the shroud 62B is arranged within the cutout 733B. This makes it possible to prevent the upper end portion of the shroud 62B from making contact with the first flat ribs 731B and second flat ribs 732B. Since the upper end portion of the shroud 62B can be caused to come close to the lower surface of the top plate portion 712B, it is possible to reduce the backflow of a gas and to increase the static pressure of the centrifugal fan device. With this configuration, it is possible to have the upper end portion of the shroud 62B and the lower surface of the top plate portion 712B of the upper impeller member 22B come close to each other in the axial direction. Accordingly, it is possible to reduce the axial dimension of the centrifugal fan device.

In the example shown in FIG. 10, the first flat ribs 731B are connected to both the lower surface of the top plate portion 712B and the radial inner surface of the outer shell portion 713B. The second flat ribs 732B are connected to both the lower surface of the top plate portion 712B and the outer circumferential surface of the cylinder portion 711B. Since each of the flat ribs extends along two surfaces of the intake portion 71B in this manner, it is preferably possible to further reduce the vibrations of the intake portion 71B. The top plate portion 712B need not necessarily be planar. The axial cross section of the top plate portion 712B may have an arch shape. In that case, the top plate portion refers to the portion having an arch-shaped cross section, which is positioned above the upper end portion of the shroud 62B.

Figure 11:
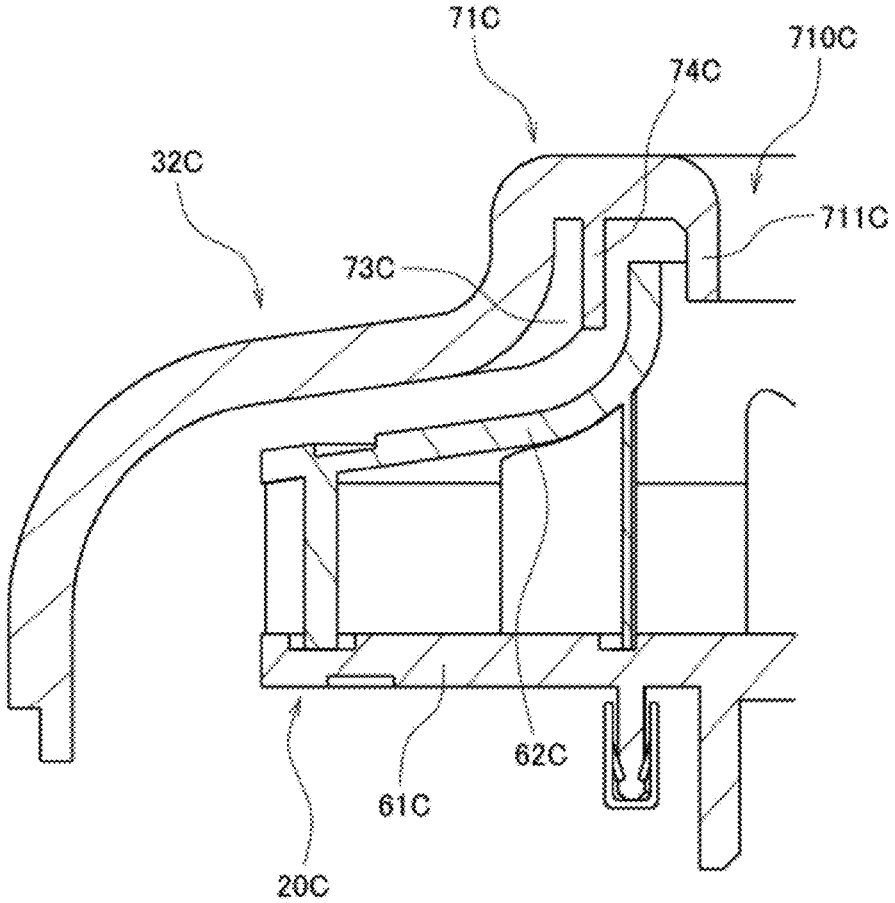
FIG. 11 is a partial vertical section view showing an upper housing member and an impeller according to another modified example of a preferred embodiment of the present invention.
Figure 12:
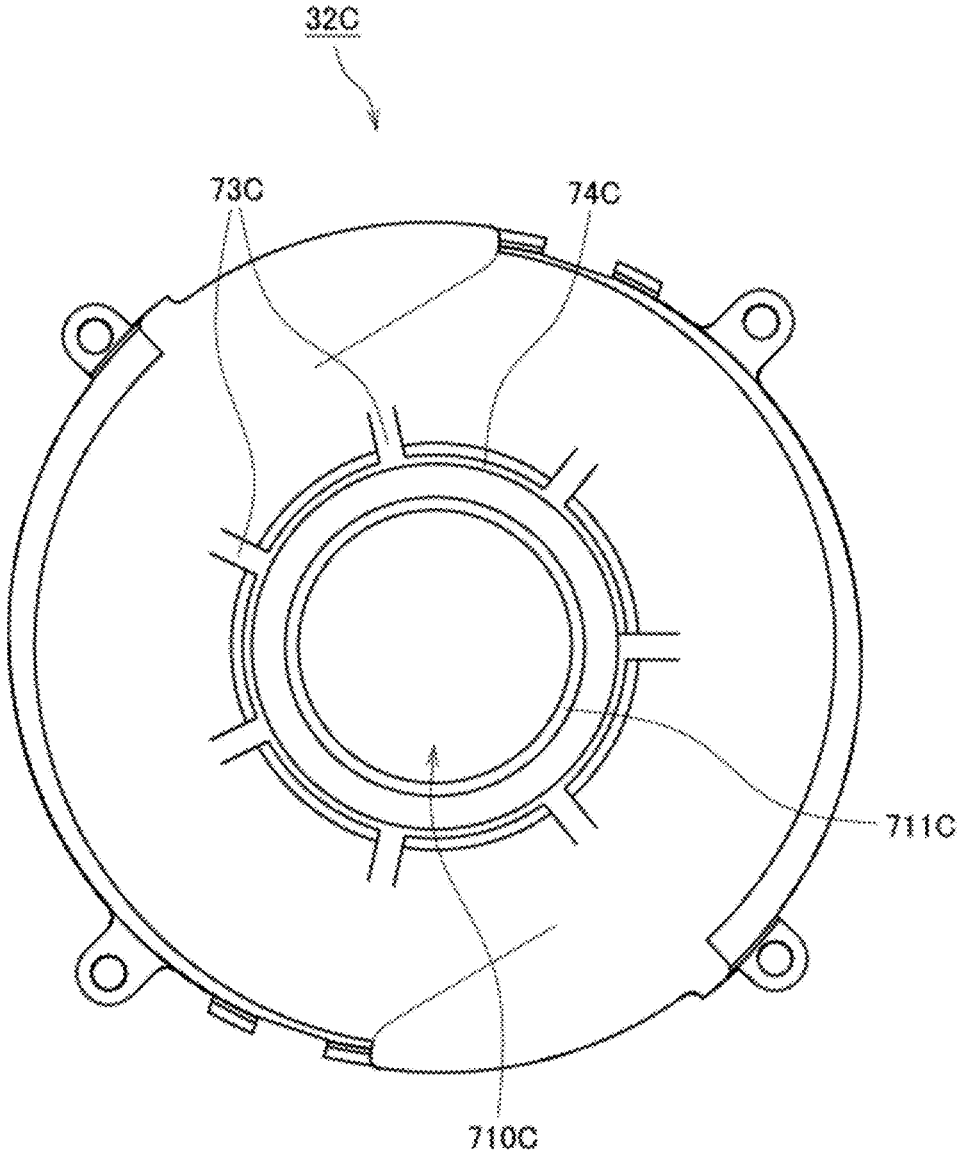
FIG. 12 is a bottom view of the upper housing member shown in FIG. 11.

FIG. 11 is a partial vertical section view showing an upper housing member 32C and an impeller 20C in accordance with another modified example of a preferred embodiment of the present invention. FIG. 12 is a bottom view of the upper housing member 32C shown in FIG. 11. In the example shown in FIGS. 11 and 12, a plurality of flat ribs 73C and a single ring-shaped rib 74C are preferably provided on the inner surface of the intake portion 71C. The ring-shaped rib 74C is positioned radially outward of the upper end portion of the shroud 62C. The ring-shaped rib 74C surrounds the upper end portion of the shroud 62C and extends in the axial direction. The positioning the ring-shaped rib 74C preferably makes it possible to further increase the rigidity of the intake portion 71C.

In this example, as shown in FIG. 11, the lower end portion of the ring-shaped rib 74C is positioned lower than the upper end portion of the shroud 62C. The ring-shaped rib 74C, the upper end portion of the shroud 62C and the cylinder portion 711C overlap in the radial direction. This makes it possible to further prevent a gas from flowing from the intake port 710C into a space between the shroud 62C and the upper housing member 32C. Accordingly, it is possible to efficiently draw a gas from the intake port 710C into a space between the base 61C and the shroud 62C. As a result, it is possible to further increase the static pressure of the centrifugal fan device.

As a further modified example of a preferred embodiment of the present invention, the flat ribs may be omitted and only the ring-shaped rib may be provided on the inner surface of the intake portion of the upper housing member.

The material of the impeller 20 and the housing 30 may preferably be a resin as in the aforementioned preferred embodiments or may be other desirable materials. For example, one or both of the impeller 20 and the housing 30 may be made of metal if so desired.

The second protrusions may be provided in the lower impeller member and the second recesses may be provided in the upper impeller member. The lower impeller member may include the base and the blades and the upper impeller member may be defined by only the shroud. In that case, for example, the positions of the upper surfaces of the blades and the lower surface of the shroud may be decided by welding or fitting. The impeller may alternatively be defined by one member or three or more members.

The diameter of the second recess 212*s*, one of the second recesses 212, may be set smaller than the diameter of the remaining second recesses 212. Likewise, the diameter of the second protrusion 222*s*, one of the second protrusions 222, may be set smaller than the diameter of the remaining second protrusions 222.

The centrifugal fan device according to various preferred embodiments of the present invention may be mounted to a device other than a cleaning device. For example, the centrifugal fan device according to various preferred embodiments of the present invention may be mounted to an electronic device, such as, for example, a personal computer or the like, to cool the inside thereof. The centrifugal fan device according to various preferred embodiments of the present invention may be mounted to other different OA devices, medical instruments, home appliances, or transport machines.

Detailed configurations of the centrifugal fan device may differ from those of the preferred embodiments and modified examples described above. The individual components included in the preferred embodiments and modified examples described above may be arbitrarily combined unless contradictory to one another.

Preferred embodiments of the present invention in which the "ribs" are not essential elements but in which "recesses" and "protrusions" which determine the rotation positions are alternative essential elements is also possible. This preferred embodiment corresponds to a centrifugal fan device preferably including: an impeller supported to rotate about a center axis extending in an up-down direction; a motor arranged to rotate the impeller; and a housing arranged to surround the impeller. The housing preferably includes an intake portion positioned above the impeller and an exhaust portion positioned radially outward of the impeller. The impeller preferably further includes a lower impeller member and an upper impeller member positioned above the lower impeller member, one of the lower impeller member and the upper impeller member including a plurality of recesses and the other of the lower impeller member and the upper impeller member including a plurality of protrusions fitted to the recesses. The recesses preferably include a single large-diameter recess that is larger in diameter than the remaining recesses, the protrusions including a single large-diameter protrusion that is larger in diameter than the remaining protrusions and the large-diameter protrusion being fitted to the large-diameter recess.

With the preferred embodiment of the present invention described just above, the relative rotation positions of the lower impeller member and the upper impeller member with respect to the center axis can be decided by fitting the large-diameter recess and the large-diameter protrusion together. The individual components included in the preferred embodiments and modified examples described above may be combined with the preferred embodiment of the present invention described just above.

Preferred embodiments of the present invention can find their application in a centrifugal fan device.

While preferred embodiments of the present invention have been described above, it is to be understood that variations and modifications will be apparent to those skilled in the art without departing from the scope and spirit of the present invention. The scope of the present invention, therefore, is to be determined solely by the following claims.

What is claimed is:

1. A centrifugal fan device, comprising:

an impeller supported to rotate about a center axis extending in an up-down direction;

a motor arranged to rotate the impeller; and a housing arranged to surround the impeller; wherein the housing includes an intake portion positioned above the impeller and an exhaust portion positioned radially outward of the impeller;

the impeller includes a base extending in a direction perpendicular or substantially perpendicular to the center axis, a ring-shaped shroud positioned above the base and having a diameter which decreases as it goes upward, and a plurality of blades existing between the base and the shroud;

the intake portion includes a cylinder portion positioned radially inward of an upper end portion of the shroud to extend in an axial direction, a top plate portion extending radially outward from an upper end portion of the cylinder portion and an outer shell portion extending downward and radially outward from a radial outer edge of the top plate portion;

the housing further includes a plurality of ribs protruding from an inner surface of the intake portion toward the shroud; and the ribs are spaced apart from one another at intervals in a circumferential direction of the centrifugal fan device.

2. The device of claim 1, wherein each of the ribs includes a radial inner edge positioned radially outward of the upper end portion of the shroud, the ribs being connected to a lower surface of the top plate portion.

3. The device of claim 2, wherein a radial distance dl between a radial inner edge of each of the ribs and an outer circumferential surface of the upper end portion of the shroud, a radial distance d2 between a radial inner surface of the outer shell portion and the outer circumferential surface of the upper end portion of the shroud, and an axial distance d3 between a lower surface of a section of the outer shell portion lying radially outward of the ribs and an upper surface of the shroud, satisfy a relationship of d2 >d3 >d1.

4. The device of claim 3, wherein, when seen in a vertical cross section including the center axis and the ribs, a lower edge of each of the ribs is joined to a lower surface of the outer shell portion, and the lower surface of the section of the outer shell portion lying radially outward of the ribs is positioned lower than a lower end portion of each of the ribs.

5. The device of claim 1, wherein, when seen in a vertical cross section including the center axis and the ribs, a lower edge of each of the ribs is joined to a lower surface of the outer shell portion, the outer shell portion including a section positioned radially outward of the ribs, the section of the outer shell portion including a lower surface positioned lower than a lower end portion of each of the ribs.

6. The device of claim 1, wherein each of the ribs include a first rib positioned radially outward of the upper end portion of the shroud and a second rib positioned radially inward of the upper end portion of the shroud.

7. The device of claim 6, wherein each of the ribs includes a cutout arranged between the first rib and the second rib.

8. The device of claim 6, wherein the second rib is connected to a lower surface of the top plate portion.

9. The device of claim 1, wherein a total number of the ribs of the housing does not equal any one of a total number of the blades of the impeller, a total number of poles of the motor, and a total number of slots of the motor.

10. The device of claim 1, wherein the ribs include a ring-shaped rib positioned radially outward of the upper end portion of the shroud and extending in a circumferential direction, the ring-shaped rib being connected to two or more of the ribs.

11. The device of claim 1, wherein the cylinder portion includes a lower end portion positioned lower than the upper end portion of the shroud.

12. The device of claim 1, wherein the top plate portion includes a planar upper surface.

13. The device of claim 1, wherein the housing is a resin molded article.

14. A centrifugal fan device, comprising:

an impeller supported to rotate about a center axis extending in an up-down direction;

a motor arranged to rotate the impeller; and a housing arranged to surround the impeller; wherein the housing includes an intake portion positioned above the impeller and an exhaust portion positioned radially outward of the impeller;

the impeller includes a lower impeller member and an upper impeller member positioned above the lower impeller member; and one of the lower impeller member and the upper impeller member includes a plurality of recesses, the other of the lower impeller member and the upper impeller member including a plurality of protrusions being fitted to the recesses;

the recesses includes a single different-diameter recess differing in diameter from the remaining recesses, the protrusions including a single different-diameter protrusion differing in diameter from the remaining protrusions, the different-diameter protrusion fitted to the different-diameter recess.

15. The device of claim 14, wherein the single different-diameter recess is a small-diameter recess smaller in diameter than the remaining recesses, the single different-diameter protrusion being a small-diameter protrusion smaller in diameter than the remaining protrusions.

16. The device of claim 14, wherein the single different-diameter recess is a large-diameter recess larger in diameter than the remaining recesses, the single different-diameter protrusion being a large-diameter protrusion larger in diameter than the remaining protrusions.

* * * * *